US005592780A

United States Patent [19]

Checkovich

[11] Patent Number: 5,592,780

[45] Date of Patent: Jan. 14, 1997

[54] DOOR POSITION CONTROLLING APPARATUS

[76] Inventor: Peter Checkovich, 8 Locust St., Burlington, Mass. 01803

[21] Appl. No.: 479,151

[22] Filed: Jun. 7, 1995

[51] Int. Cl.[6] ..... E05F 1/10; E05F 3/00

[52] U.S. Cl. ..... 49/386; 16/49; 16/66; 16/DIG. 17; 49/394

[58] Field of Search ..... 49/386, 394; 16/49, 16/66, 82, 84, DIG. 17, 70

[56] References Cited

U.S. PATENT DOCUMENTS

| | | | |
|---|---|---|---|
| 1,934,554 | 11/1933 | Nabb | 16/70 |
| 2,808,608 | 10/1957 | O'Hare | 16/70 |
| 2,920,338 | 1/1960 | Falk | 16/66 |
| 2,940,111 | 6/1960 | Patriquin | 16/66 |
| 3,032,806 | 5/1962 | Mallory | 16/66 |
| 3,105,264 | 10/1963 | Truhon | 16/66 |
| 3,162,889 | 12/1964 | Runnels | 16/66 |
| 3,415,562 | 12/1968 | Petersen | 16/DIG. 17 X |
| 4,069,544 | 1/1978 | D'Hooge | 16/49 |
| 4,216,694 | 8/1980 | Ramsey et al. | 16/66 X |
| 4,670,939 | 6/1987 | Fisher | 16/DIG. 17 X |
| 4,722,116 | 2/1988 | Erickson | 16/49 |
| 4,777,698 | 10/1988 | Lord | 16/66 |
| 4,803,754 | 2/1989 | Roberts | 16/DIG. 17 X |
| 4,813,100 | 3/1989 | King | 16/49 |
| 4,815,163 | 3/1989 | Simmons | 16/DIG. 17 X |
| 5,048,150 | 9/1991 | Guerin | 16/DIG. 17 X |

*Primary Examiner*—Philip C. Kannan
*Attorney, Agent, or Firm*—Charles C. Valauskas

[57] ABSTRACT

An apparatus for controlling the position of a door suitable for use in association with door closing piston assemblies having a spring-biased reciprocable door closing piston rod and a latch plate transversely slidable along the length of the piston rod. By use of the present invention, a momentary initial rotational bias may be imparted to the latch plate automatically and electronically, thereby causing it to shift the latch plate towards a rotated angle while the door is closing, and to facilitate pre-positioning the latch plate to set into a locking hold-open orientation without any subsequent manual adjustment.

20 Claims, 6 Drawing Sheets

DOOR POSITION CONTROLLING APPARATUS

BACKGROUND OF THE INVENTION

1. Field of the Invention

The invention is directed to door closer check devices of the type having a reciprocable spring-biased door closing piston assembly combined with a latch plate that is transversely slidable along the length of the piston rod and can be set to prevent the door from closing completely. More specifically, the invention relates to an apparatus for setting the latch plate on such devices electronically, such that the door may be selectively positioned partially or completely open indefinitely and until subsequently released.

2. Prior Art

Doors such as with side-hinged screen doors, storm doors, and the like conventionally include means that close the door. Such means may be as simple and inexpensive as a spring that pulls a released, unblocked door closed in a generally uncontrolled fashion. More controlled means by which a released, unblocked door may be closed include a piston assembly. The door piston assembly typically consists of a cylindrical tube attached at one end to a bracket connector on the door. Within the inner surface of the cylindrical tube a spring-loaded piston may slide. A reciprocating connecting rod extends from the piston and out of the cylindrical tube. The end of the connecting rod opposite to the end carried within the cylindrical tube typically is attached to the door frame. When the door is opened, the connecting rod is pulled from the cylindrical tube, causing the piston to travel within the inner surface of the cylinder and thereby a spring coiled between an inner wall of the cylinder and the piston to compress. Upon the door being released, energy stored within the coiled spring pushes against a surface of the piston, causing it to slide within the cylinder and the connecting rod to be drawn back within the cylindrical tube and thereby the door to close. The retracting momentum of the piston is typically cushioned by compression of fluid such as oil or air inside the cylindrical tube to create a damping resistance contrary to the force that propels the door to close for better control of the speed and force at which the door closes.

Many conventional door closing devices include a latch plate that can be set to prevent the connecting rod from being drawn back within the cylindrical tube and thereby the door from being closed partially or completely. The latch plate typically has an aperture of a size and shaped so that the connecting rod may extend therethrough and so that the latch plate may easily slide transversely along the length of the rod. The latch plate may be rounded or L-shaped (as for example in U.S. Pat. Nos. 2,808,608 and 3,032,806) with an extending flange or embossment sized to approximate the outer diameter of the cylindrical tube. Latch plates conventionally are manually set once the door is opened on a position along the connecting rod. After the door is released, the connecting rod begins to be drawn back within the cylinder. However, with the latch plate manually set, the proximal end of the cylindrical tube makes first contact with one of the outer edges of the extending latch plate flange, causing the latch plate to tilt or rotate slightly. In consequence, the edge of the latch plate aperture makes contact with diametrically opposite sides of the connecting rod. As the cylindrical tube begins to push with greater force against the latch plate, the resistance between the edge of the latch plate aperture and the connecting rod increases thereby slowing, and eventually altogether preventing the further inward movement of the connecting rod. When the full closing force of the door closer is brought to bear against the latch plate, the latch plate cantingly locks against both the cylindrical tube and the connecting rod, thereby preventing the door from closing further. The door then remains held open in place until the blocking action of the latch plate is removed by virtue of the door being drawn slightly open, and the latch plate manually repositioned transversely along the connecting rod and away from the cylindrical tube, so that the connecting rod once again may slide through the latch plate aperture without the resistance formerely placed on the connecting rod.

One of the major disadvantages inherent in all such prior art devices concerns the oftentimes rather clumsy manipulation required when attempting to set or release the latch plate, either of which operation typically involves keeping the door held open with one arm while reaching towards and manipulating the relatively small and generally inaccessible latch plate with the other arm. It is not unusual that repeated attempts are required to set the latch plate at a discrete position along the connecting rod such that the door is held open to the desired amount. When there is insufficient light to illuminate fully the latch plate or when the latch plate must be manipulated by a user wearing gloves because of the weather, setting or releasing the latch plate may require repeated, time-consuming steps. Moreover, in situations not uncommonly encountered, where it may be desired to set the latch plate into locking position, the difficulties in manipulating, setting, and releasing the latch plate are exacerbated when one attempts to set the plate while transporting goods or while carrying an infant on one's shoulder. The user must attempt to support the goods or child in a non-conventional manner such as by carrying the weight on the user's hip or with a combination of torso and upper arm while holding the door open with the user's body and with the other arm to adjustably manipulate the hold-open latch plate transversely along the connecting rod until the plate is positioned in a locking orientation. Certain prior art devices have intended modifications to lessen or alleviate the difficulties associated with the standard latching mechanism. For example, U.S. Pat. No. 4,815,163 teaches a small extending lever to facilitate actuating the latching mechanism, U.S. Pat. No. 5,048,150 teaches a more complicated apparatus involving hydraulic pressure, and U.S. Pat. No. 4,722,116 teaches the use of wire cable lines to mechanically control the latch mechanism. These elaborate, multi-element structures are relatively more complicated and more time-consuming and more expensive to manufacture. Because of the complexity of the devices, one concern surrounding the use of them is whether they can operate repeatedly under all traffic and weather conditions.

SUMMARY OF THE INVENTION

The present invention is an apparatus for setting the latch plate on door closer check devices having a piston door closing assembly without the extensive manipulation required of conventional door closer check devices. The apparatus of the invention utilizes means to tilt the latch plate sufficiently such that the plate can be set and the door to remain open in the desired position. The present invention does not require generally fragile components and accordingly is also rugged and reliable in construction thereby facilitating repeated use such as encountered by a door through which a high volume of traffic flows. Nor does it require the use of any extensive, unwieldy or otherwise complex combination of apparatus linking between the point of mechanical activation and operator control, but relies instead upon concise means for accomplishing its purpose. It is furthermore envisioned that, in its preferred and common usage, the present invention would be readily controllable in operation from an electrical switch or sensor located separately from the rest of the device. The remote control may be installed nearby, such as by using a photoelectric sensor contained within the surrounding door frame, or could be located at some distance, as for example using a portable infrared or other wireless communication signalling unit.

It is, accordingly, a general object of the present invention to provide an apparatus for controlling the position of a door relative to the door frame.

Another added object of the present invention is to provide an apparatus for automatically controlling the relative position of a door.

An additional object of the present invention is to provide an apparatus for controlling the relative position of the door remotely and without the need for manual contact of the door positioning apparatus.

A further object of the present invention is to provide an apparatus for positioning a door that is generally compatible with many of the conventional devices presently in common use, and that can be conformably adapted without difficulty for conversion of and accommodation with such devices as are already in production or in process of being installed.

These and other features, advantages, and objects will be clearly understood and explained with reference to the accompanying drawings and from a consideration of the following detailed description of the preferred embodiments.

BRIEF DESCRIPTION OF THE DRAWINGS

In the course of this description, reference will be made to the attached drawings, wherein.

DETAILED DESCRIPTION OF THE INVENTION

A door position controlling apparatus embodying the primary features of the present invention is generally illustrated and designated by reference number 31.

Figure 1:
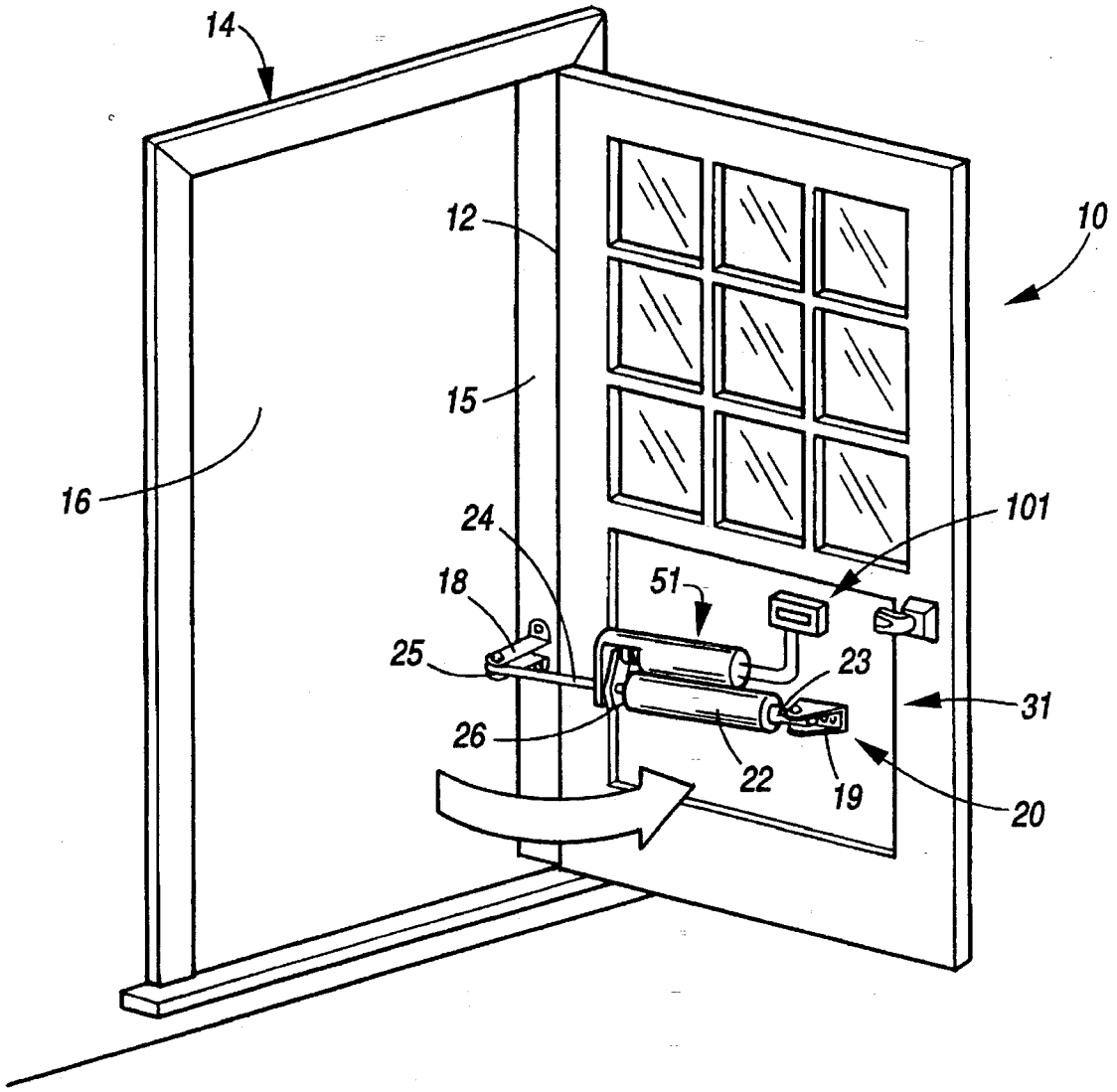
FIG. 1 is an perspective view showing a side-hinged outer door movable relative to a door frame along with a conventional type of door closing piston assembly, and a door position controlling apparatus of the present invention attached thereto.

With reference to FIG. 1, the controlling apparatus 31 is shown in a typical setting for its use in relation to a side-hinged door 10 attached along its inner vertical side 12 by hinges (not illustrated) to a door frame 14 such that the door 10 may swing open relative to the door frame 14 in the general direction of the arrow to form an opening 16 the size of which is largely controlled by the door 10. Attached to the door frame 14 is a frame bracket 18 sized and shaped to pivotally engage a frame end 25 of a connecting rod 24 extending from a cylinder 22 of a door closing piston assembly 20. Attached to the door 10 is a door bracket 19 sized and shaped to pivotally engage a door end 23 of the cylinder 22. Upon opening the door 10, the connecting rod 24 as attached to the door frame 14 by door bracket 18, is pulled out from within the cylinder 22. When the door is then subsequently released, a compression spring (not shown) contained within the cylinder 22 pushes against a piston plate (not shown) connected to an end (not shown) of the connecting rod 24 within the cylinder 22, causing the connecting rod 24 to be drawn back within the cylinder 22 and the door 10 to swing closed.

Figure 2:
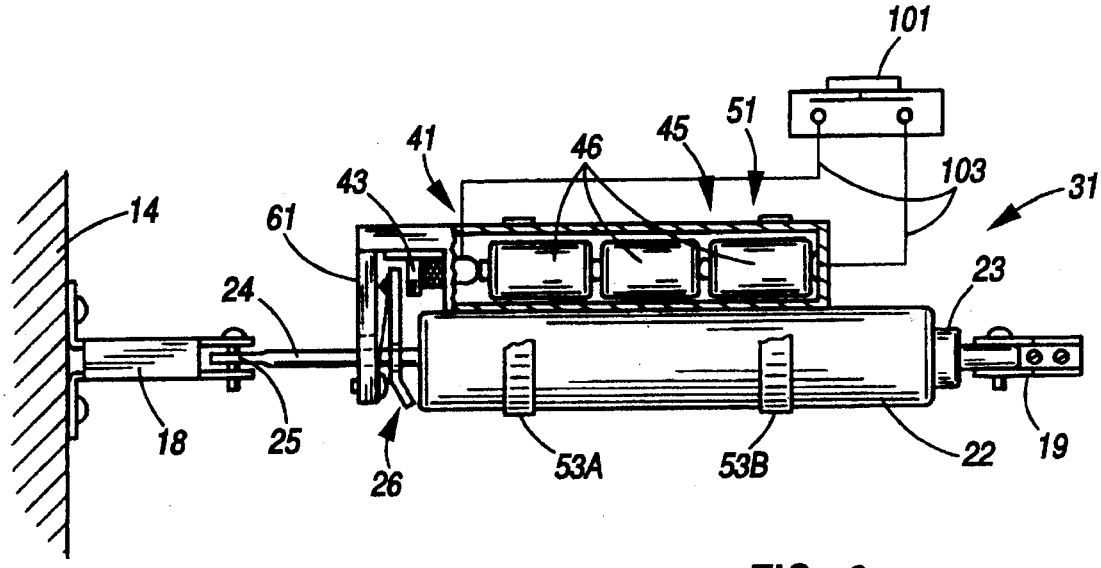
FIG. 2 is a diagrammatic cross-sectional view, showing some components of the present invention in representational form illustrated in schematic arrangement in juxtaposition to a conventional type of door closing piston assembly.
Figure 3:
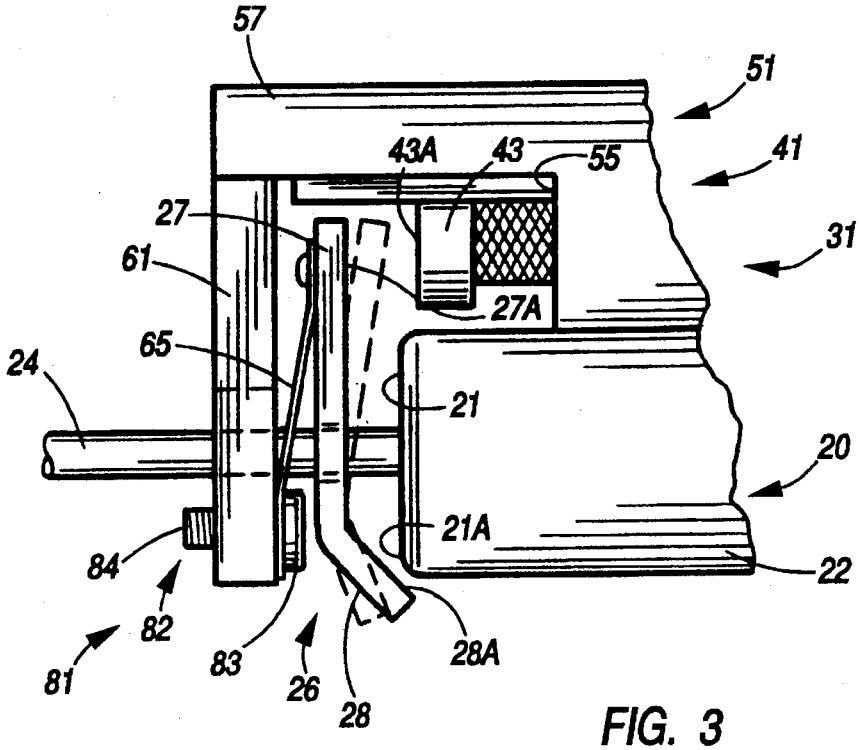
FIG. 3 is a cross-sectional view showing additional detail of the controlling apparatus as similarly depicted in FIG. 2 and illustrating in particular the motion of the conventional latch plate when acted upon by the present invention.
Figure 4:
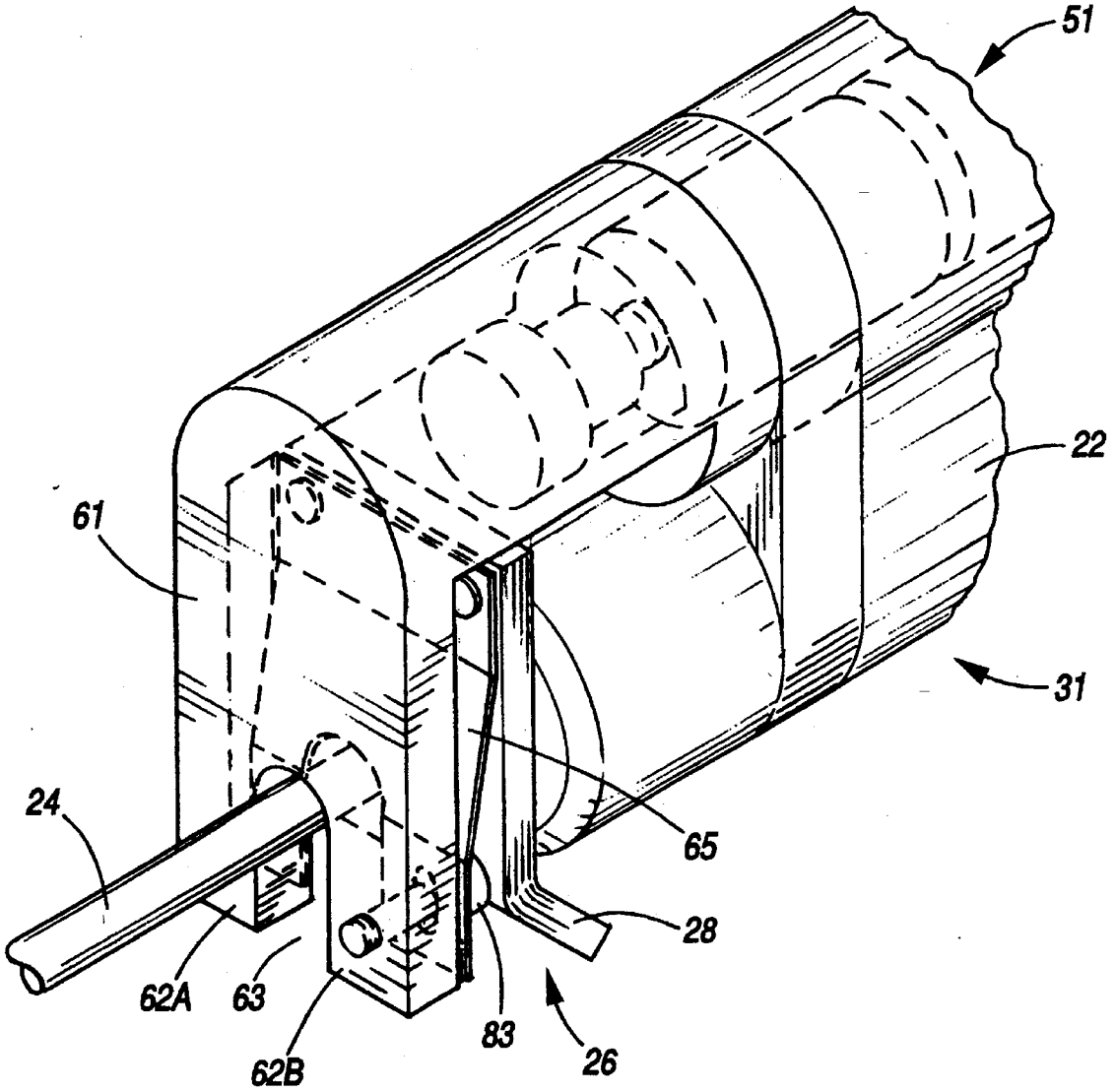
FIG. 4 is an isometric illustration which shows a three-dimensional perspective of the apparatus as similarly depicted from another orientation of the side elevational view of FIG. 3.

Conventionally, the piston assembly 20 includes a hold-open latch plate 26, having an aperture 29 sized and shaped such that the connecting rod 24 can slide through the aperture 29. As shown in more detail in FIG. 2 and FIG. 3, the hold-open latch plate 26 typically includes a radially extending flange 27 having a length that may approximate the outer diameter of the cylinder 22 and a canting tab 28 offset at an angle to the long axis along which the flange 27 runs such that a surface 28A of tab 28 may contact against an adjacent outer concentric edge 21A of the forward surface 21 of cylinder 22. The latch plate 26 typically is manually set when the door 10 is opened and at a position along the connecting rod 24 that will enable the door 10 to remain open by the blocking action of the latch plate 26 as set. When the door 10 as opened is released and the connecting rod 24 begins to be drawn back within the cylinder 22 by action of the inner cylinder spring (not shown), the edge 21A of the cylinder 22 proximal to the hold-open latch plate 26 as set makes initial contact with the latch plate 26 at surface 28A of tab 28. The contact of the edge 21A of the cylinder 22 with surface 28A of tab 28 of the latch plate 26 causes the latch plate to tilt and rotate around the latch plate aperture 29 until the latch plate 26 contacts the connecting rod 24 at positions 29A as more particularly illustrated in FIG. 7. As shown in FIG. 3, the latch plate as pre-set transfers the stored energy that impels towards door-closing into a contrariwise tendency, thereby to counterpoise the spring-biased door-closing force with a rotational contacting pressure. When it is properly pre-set in such fashion, the latch plate 26 catches and acts as a stopping wedge between the connecting rod 24 and the cylinder 22 and the contacting pressure impinging upon the connecting rod 24 is sufficient to outweigh the momentum of the door closing piston assembly 20, thus providing a block for holding the door in stationary position.

The apparatus 31 for controlling the relative position of a door 10 having a hold-open latch plate of the type described above includes means 41 by which the latch plate 26 can be tilted and thereby rotated around the aperture 29 such that the latch plate 26 is set to block the further return of the connecting rod 24 into the cylinder 22.

The tilting means 41 of the present invention may take a variety of forms. One embodiment includes a magnetic head 43, which is able to produce a sufficient magnetic field to draw a latch plate 26 composed in part or in whole, of ferromagnetic material that can be drawn by a magnetic field such that the plate is rotated into a tilted relationship relative to the aperture 29. Illustrated in FIGS. 1 through 7 is an embodiment in which the magnetic head 43 is an electromagnet securably disposed such that a head surface 43A is in near proximity to one adjacent surface 27A of the flange 27 of latch plate 26. The illustrated magnetic head 43 may be magnetized with the power from a source 45 such as one or more dry-cell batteries 46 as depicted in the Figures, or externally. The tilting means 41 may be contained within and mounted in such relationship to the latch plate 26 and the piston assembly 20 by a mounting container 51. The container 51 is positionally adjustable along the axial length of the piston assembly 20, in parallel co-alignment therewith. Container 51 may be attached to the piston assembly 20 such as with a pair of arcuate-shaped clamping flanges 53A, 53B sized to conform with external circumferences on the common varieties of conventional door closing piston assemblies 20 and tightened around the cylinder 22 of the door piston assembly 20.

A backing plate 61 connects to a forward end 55 of the mounting container 51 by an arm 57 and projects towards and around the connecting rod 24. The backing plate 61 confinably captures the slidable latch plate 26 within a narrowly defined range of distance between the backing plate 61 and the forward surface 21 of the cylinder 22 of the door piston closing assembly 20. The backing plate 61 thus serves to maintain the latch plate 26 in a position of near proximity to the tilting means 41 even while the door 10 is being opened.

The backing plate 61 is sized and shaped to allow the connecting rod 24 to slidably extend through the backing plate 61. The backing plate 61 as shown more particularly in FIG. 4 includes a pair of tandem flattened prongs 62A, 62B straddling either side of and forming a slot 63 through which the connecting rod 24 may extend.

The latch plate 26 is connected to the backing plate 61 and biasable towards a non-locking orientation during normal operation of opening and closing of the door 10 by flexing means 65. The flexing means 65 are shown as a leaf spring. The latch plate 26 remains thus inactivated from locking until the tilting of the latch plate 26 is initialized electronically, whereupon the latch plate 26 cantingly tilts toward its set locking orientation.

Figure 5:
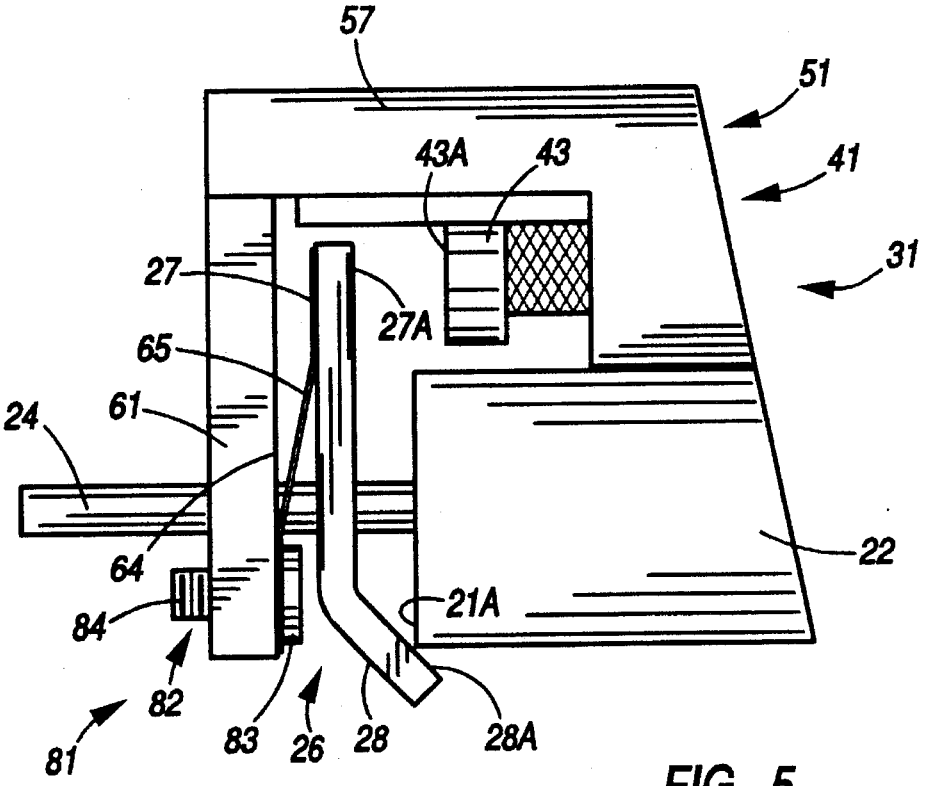
FIG. 5 through FIG. 7 are additional cross-sectional views showing in representational form the motion of the latch plate as acted upon by the present invention.
Figure 6:
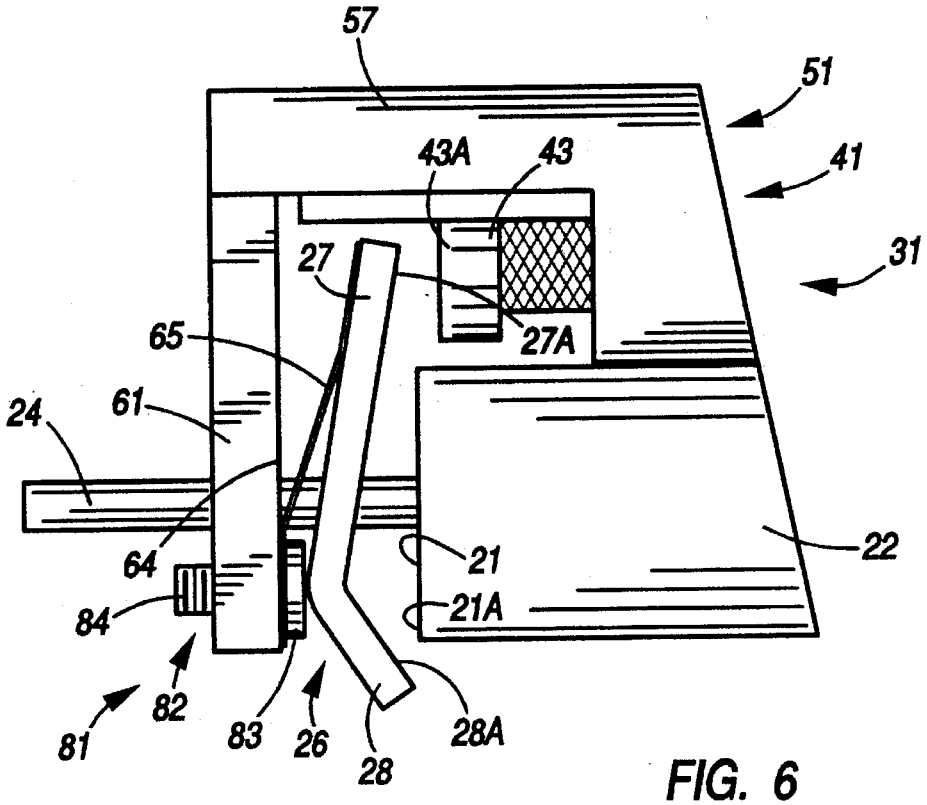
Figure 7:
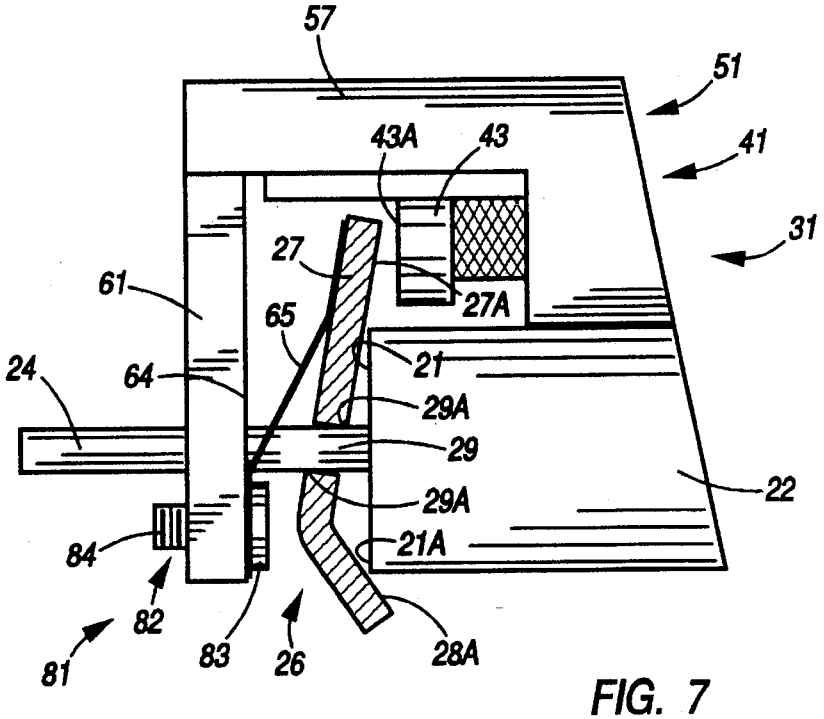

As shown more fully in the diagrams of FIGS. 5 through 7, in consequence of a momentary rotational shift induced by the tilting means 41, and with the door moving towards a closing direction a slight additional push to the tab 28 from the cylinder 22 causes the latch plate 26 to become interpolated between the cylinder 22 and the connecting rod 24, thereupon locking into a set position for keeping the door 10 held open. The door 10 remains held in place until it is subsequently manually drawn towards opening, whereupon the latch plate 26, becoming released from its locking orientation, then automatically reverts back toward its non-rotated orientation due to flexing bias derived from the flexing means 65, thus to return the latch plate 26 to its non-clamping orientation. The amount of flexing bias in the illustrated leaf spring embodiment of the flexing means 65 should be sufficient to prevent the latch plate 26 from shifting into a locking set inadvertently prior to activation, while yet permitting unhindered compliance with the amount of force deriving upon activation from the tilting means 41.

The configuration of the latch plate 26 is sized and shaped, as shown most clearly in FIG. 3, with one longitudinal surface 27A of the latch plate 26 in close disposition relative to the tilting means 41 such that, for example, upon electronic activation of the magnetic head 43 the latch plate 26 may cant toward the tilting means 41 by magnetic attractive force. To facilitate such rotation of the latch plate 26, the latch plate 26 may be composed in part or in whole of iron, steel, nickel or other ferromagnetic material. The angularly offset outer tab 28 preferably is disposed within a distance of a few millimeters from the adjacent surface 21A of the cylinder 22.

Figure 8A:
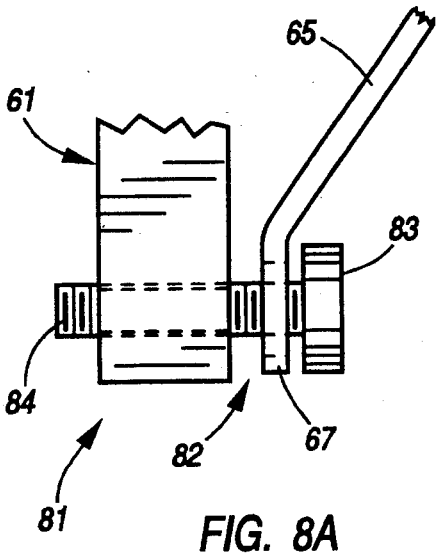
FIG. 8A through FIG. 8C illustrate additional detail of the attachment of the flexing means to the backing plate, with FIG. 8A being a side cross-sectional view and FIG. 8B and FIG. 8C being front elevational views showing a cutaway cross-section.
Figure 8B:
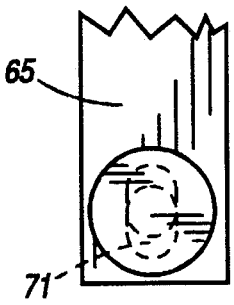
Figure 8C:
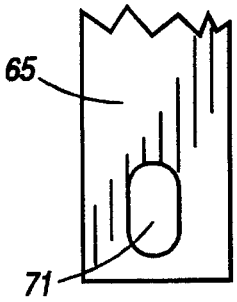

Simultaneous with the rotational motion of the latching plate 26, impelled by the canting rotational force derived from the tilting means 41, a slight vertical momentum also occurs which tends to shift the vertical position of the latch plate 26 and of the flexing means 65 attached thereto, thus to slightly alter the degree of the angle of the latch plate 26 in shifting away from its resting orthogonal position. This slight vertical shift permits the latch plate 26 to become better positioned for setting into a locking orientation. The illustrated embodiment shows the means 81 by which the flexing means 65 may be connected to the backing plate 61. The illustrated connecting means 81 includes a bolt 82 having a head 83 sized and shaped to capture one end 67 of the flexing means generally against a surface 64 of the backing plate 61. With reference to FIGS. 8A through 8C, the bolt 82 includes a length 84 sized and shaped to extend through anchoring slots 71. Slots 71 are somewhat oblongated in their geometry in order to adjustably accommodate the amount of vertical repositioning of the flexing means 65 that occurs concomitantly upon activational rotation of the latch plate 26.

To facilitate the most efficient operation of the present invention, the tilting means 41 and, in particular, the magnetic head 43 preferably is positioned neither so distant from the latch plate 26 as to obviate effective activational control nor so proximal as to preclude the latch plate 26 from having a certain amount of leeway to permit its canting rotational motion. The backing plate 61 is preferably positioned in relationship to the mounting container 51 nearly proximal to the hinged side 15 of the door frame 14 and should also be adjusted in position to maintain a close alignment conformable with the rotational action of the latch plate 26 again so as not to preclude canting rotation of the hold-open latch plate 26 induced by activation of the tilting means 41, which with proper adjustment should be possible to accomplish for any location of the latch plate 26 in relative juxtaposition along the entire length of the extending connecting rod 24, corresponding to whatever selected position of the held-open door whether fully or partially opened.

Figure 9A:
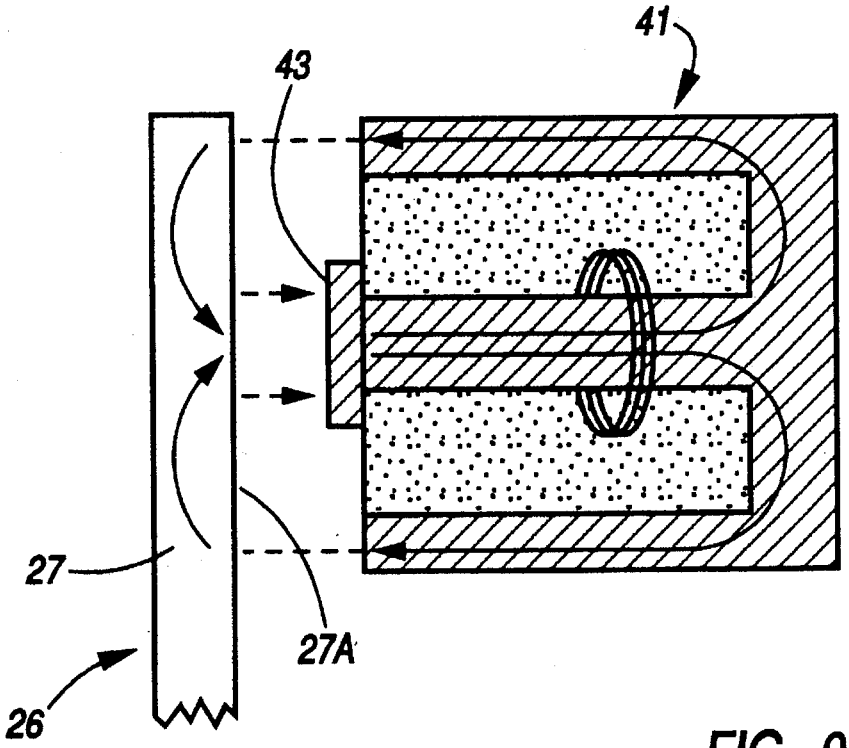
FIG. 9A is a diagram showing the electromagnetic tilting means from a preferred embodiment of the present invention.
Figure 9B:
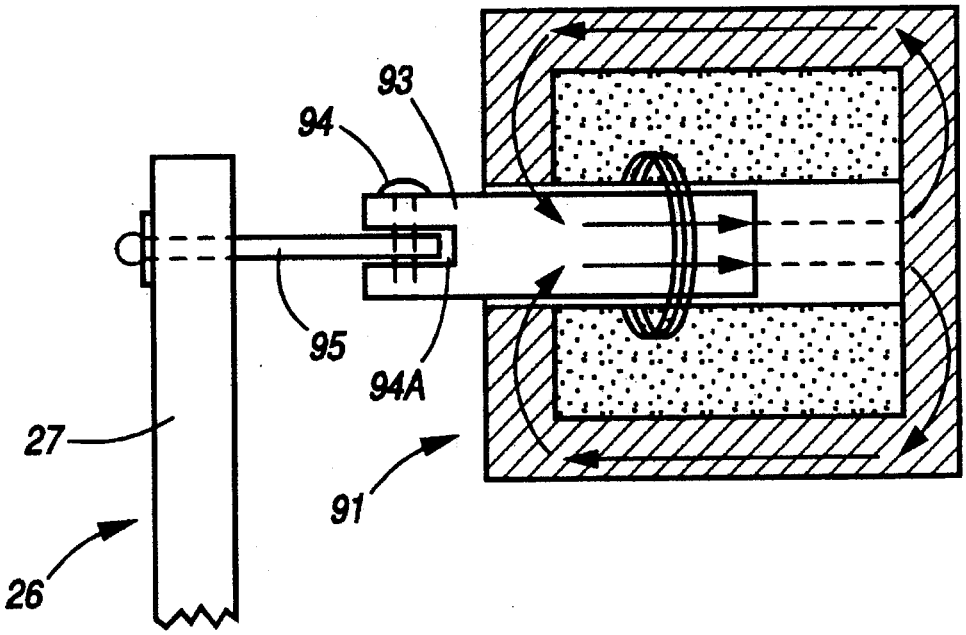
FIG. 9B is a diagram showing an alternative embodiment having a solenoid tilting means.

FIG. 9A illustrates the tilting means 41 and, in particular, the magnetic head 43 in spaced relationship from the latch plate 26. An alternative embodiment of the present invention is shown in FIG. 9B. The FIG. 9B embodiment includes an electromagnetically controlled solenoid 91 containing a retractable armature 93 which upon electrical activation exerts transverse mechanical impetus to a connecting pin 94, linking through a pivoting lever 95 to direct rotational torque towards an associated latch plate 26 capable to angularly control setting a hold-open door check device similarly as described in the foregoing. To facilitate the movement of the latch plate 26, the lever 95 may also be formed from a flexible material to accommodate the movement of the latch plate 26 as pulled by the retracting armature 93.

The present invention includes an actuator 101 to activate the tilting means 41 by manual touch and without the cumbersome manipulation required by conventional latch plates. FIG. 1 and FIG. 2 illustrates an actuator 101 by which a command can be communicated through wiring 103 to the tilting means 41 to activate it and move the latch plate 26 to a blocking position. The actuator 101 may also be an electrical switch of any other type including but not limited to a toggle, pushbutton, rotary, light-detecting, audible sound-detecting, non-audible sound-detecting, motion-responsive, pressure-responsive, or infrared- or radiofrequency responsive type of switch or other means for the switching or controlling of an electronic circuit.

In either of the two main embodiments, a momentary rotational shift of the latch plate in coordination with a short door closing motion as occurring from urging of the door closer mechanism suffices for the latch plate to become set into position. Thus, the energy requirements during normal usage for either of the main embodiments as described are very minimal, since only a modest energizing electromechanical activation is needed to overcome the additional flex induced in the flexing means 65 during rotation of the latch plate 26, and since the latch plate 26 only needs to be shifted in its relative angular rotation for a brief duration of time before the closing motion of the door causes the latch plate to set securely into a clamping position for keeping the door held open. Moreover, there is no additional amount of electrical energy needed after the latch plate 26 is set into its hold-open position, and thus no additional electricity is consumed while the door 10 is being kept open, beyond what was minimally required to accomplish initially setting the latch plate into its pre-locking rotational orientation.

As will be understood by those skilled in the art, various arrangements other than those described in detail in the specification will occur to those persons skilled in the art which arrangements are within the spirit and scope of the invention. It is, therefore, to be understood that the invention is to be limited only by the claims appended hereto.

What is claimed is:

1. An apparatus for controlling the position of a door relative to a door frame, the door having a piston closing assembly attached thereto, the piston closing assembly including a cylinder, a connecting rod connected at a frame end to the door frame and at a door end to the door, the connecting rod slidably extending from an end of the cylinder such that the connecting rod may slide into the end of the cylinder to allow the door to be closed and out from the end of the cylinder to allow the door to be opened, and a latch plate carried around the connecting rod such that in a non-tilted position the connecting rod travels generally smoothly though the latch plate and by tilting the latch plate to a blocking position, the connecting rod is prevented from sliding into the cylinder and the door is prevented from closing, said controlling apparatus comprising:

means for tilting the latch plate to the blocking position to prevent further movement of the connecting rod into the cylinder and the door thereby to close, said tilting means including an electromagnet positioned in proximity to a surface of the latch plate such that when such electromagnet is activated the latch plate is tilted to the blocking position, said tilting means mounted adjacent to the piston closing assembly by a mounting container;

an actuator communicating with said tilting means to activate said electromagnet and cause the latch plate to tilt to the blocking position;

means for flexing the latch plate to the not-tilted position, said flexing means connected to the latch plate and sized and shaped and having a composition such that the latch plate is maintained in the non-tilted position without activation of the tilting means; and a backing plate connected to said flexing means and to said mounting container such that the latch plate surface is confinably positioned proximate to said tilting means so that the latch plate is tiltable upon activation of said electromagnet.

2. The door position controlling apparatus as defined in claim 1, wherein said electromagnet is powered by a self-contained power source.

3. The door position controlling apparatus as defined in claim 1, wherein said electromagnet is powered by an external power force.

4. The door position controlling apparatus as defined in claim 1, wherein said flexing means includes a leaf spring.

5. The door position controlling apparatus as defined in claim 1, wherein said actuator includes an electrical switch in wireless communication with said tilting means.

6. The door position controlling apparatus as defined in claim 1, wherein said tilting means is powered by an external power source.

7. The door position controlling apparatus as defined in claim 1, wherein said mounting container includes flanges by which said mounting container is releasably positionable to the piston closing assembly.

8. A door position controller for setting a latch plate having a plate aperture through which a connecting rod is moveable out from or into a cylinder of a door closing piston assembly, the connecting rod moveable from the cylinder as the door is opened, and moveable into the cylinder as the door is closed, the plate aperture sized to facilitate the tilting of the latch plate such that the latch plate as tilted grippingly contacts the connecting rod and thereby prevents the connecting rod from being drawn back into the cylinder, said door position controller comprising:

a mounting container adjustably positioned adjacent to the door closing piston assembly, said mounting container including a forward end;

means for tilting the latch plate, said tilting means including a magnetic head mounted in general close proximity to the latch plate by said mounting container such that upon activation of said magnetic head one end of the latch plate tilts towards said magnetic head until the latch plate grippingly contacts the connecting rod;

an actuator by which said tilting means can be activated to tilt the latch plate;

a backing plate connected to said forward end of said mounting container and alignably generally perpendicular to the connecting rod; and means for flexing the latch plate, said flexing means attached to said backing plate and to the latch plate, flexing means sized and shaped and including flexible material such that upon deactivation of said magnetic head the latch plate is drawn into generally non-tilted alignment relative to the connecting rod and to lessen the gripping contact of the latch plate with the connecting rod.

9. The door position controller as defined in claim 8, wherein said actuator includes wires to communicate with said tilting means.

10. The door position controller as defined in claim 8, wherein said actuator includes means by which said tilting means is activatable through wireless communication.

11. The door position controller as defined in claim 8, wherein said tilting means is powered by a self-contained power source.

12. The door position controller as defined in claim 8, wherein said tilting means is powered by an external power source.

13. The door position controller as defined in claim 8, wherein said backing plate includes a slot through which the connecting rod can extend.

14. An apparatus for controlling the alignment of a door hold open latch plate relative to a connecting rod, the connecting rod moveable relative to a cylinder of a closing piston assembly for a door, the latch plate including an edge forming an aperture through which the connecting rod can easily slide when the latch plate is positioned in a generally perpendicular alignment relative to the connecting rod and thereby allowing the door to close, the latch plate sized and shaped and including a flange such that when the latch plate is tilted relative to the connecting rod the aperture edge grippingly contacts the connecting rod thereby preventing the connecting rod from being drawn back into the cylinder of the piston assembly and the door from closing, said latch plate alignment controlling apparatus comprising:

an electromagnetically controlled solenoid including a retractable armature connected to the latch plate by a lever, said solenoid structured to exert pulling action on said lever and thereby to tilt the latch plate;

an actuator in communicative contact with said solenoid and by which said solenoid can be activated to pull said lever and tilt the latch plate and by which said solenoid can be deactivated to decrease the pulling action on said lever and allow the latch plate to return to the generally perpendicular alignment relative to the connecting rod; and flexing means, said flexing means sized and shaped and attached to the latch plate such that latch plate is drawn to the generally perpendicular alignment relative to the connecting rod such as upon deactivation of said solenoid by said actuator thereby allowing the door to close.

15. The controlling apparatus as defined in claim 14, wherein said flexing means includes a leaf spring.

16. The controlling apparatus as defined in claim 14, wherein said lever includes flexible material to facilitate variable movement of the latch plate.

17. The controlling apparatus as defined in claim 14, further including a mounting by which said solenoid is positionable adjacent to the closing piston assembly.

18. The controlling apparatus as defined in claim 17, further including a backing plate connected to said mounting and to said flexing means, said backing plate aligned generally perpendicular to the connecting rod and forming a narrow space relative to a forward end of the closing piston assembly to capture the latch plate thereinbetween.

19. The controlling apparatus as defined in claim 14, further including a backing plate to which said flexing means is attached, said backing plate aligned to confine the latch plate in close proximity to the cylinder of the closing piston assembly.

20. The controlling apparatus as defined in claim 19, wherein said backing plate includes a slot through which the connecting rod may extend.

* * * * *